US007243643B2

(12) United States Patent
Iwami et al.

(10) Patent No.: US 7,243,643 B2
(45) Date of Patent: Jul. 17, 2007

(54) IGNITION DEVICE FOR INTERNAL COMBUSTION ENGINE

(75) Inventors: Atsushi Iwami, Susono (JP); Tetsuya Miwa, Nagoya (JP); Hiromi Hiramatsu, Kariya (JP); Yoshiki Morita, Kariya (JP)

(73) Assignee: DENSO Corporation (JP)

( * ) Notice: Subject to any disclaimer, the term of this patent is extended or adjusted under 35 U.S.C. 154(b) by 199 days.

(21) Appl. No.: 11/131,346

(22) Filed: May 18, 2005

(65) Prior Publication Data

US 2005/0284454 A1 Dec. 29, 2005

(30) Foreign Application Priority Data

May 21, 2004 (JP) ..... 2004-152171
Feb. 18, 2005 (JP) ..... 2005-042260

(51) Int. Cl.
*F02P 1/00* (2006.01)

(52) U.S. Cl. ..... 123/635; 123/169 PA

(58) Field of Classification Search ..... 123/634–635, 123/647, 169 PA
See application file for complete search history.

(56) References Cited

U.S. PATENT DOCUMENTS 6,170,451 B1 * 1/2001 Moriya ..... 123/169 PA
6,178,957 B1 * 1/2001 Widiger et al. ..... 123/634
6,406,307 B2 * 6/2002 Bungo et al. ..... 439/130
6,443,137 B1 * 9/2002 Kraft et al. ..... 123/634
6,675,760 B1 * 1/2004 Gahrken et al. ..... 123/193.5
6,694,958 B2 2/2004 Hiramatsu et al.
6,819,030 B2 * 11/2004 Lipp et al. ..... 313/118
6,880,540 B2 * 4/2005 Fuma et al. ..... 123/634
6,975,062 B2 * 12/2005 Suzuki et al. ..... 313/132
7,080,638 B2 * 7/2006 Mizutani et al. ..... 123/635

FOREIGN PATENT DOCUMENTS

JP 60-29388 2/1985

* cited by examiner

*Primary Examiner*—Hai Huynh
(74) *Attorney, Agent, or Firm*—Nixon & Vanderhye PC

(57) ABSTRACT

An ignition device for an internal combustion engine has a spark plug, an ignition coil, a housing and a mounting portion. The spark plug is for discharging a current to ignite an air-fuel mixture in a combustion chamber of the internal combustion engine. The ignition coil is for supplying the current to the spark plug. The housing encloses the spark plug and the ignition coil therein. The housing has a mounting portion to be disposed in a mounting hole provided in a cylinder head of the internal combustion engine. The mounting portion includes a screw portion a non-screw portion. The screw portion is to be screw-fastened to the mounting hole. The non-screw portion is not to be screw-fastened to the mounting hole.

18 Claims, 5 Drawing Sheets

IGNITION DEVICE FOR INTERNAL COMBUSTION ENGINE

CROSS REFERENCE TO RELATED APPLICATION

This application is based on Japanese Patent Applications No. 2004-152171 filed on May 21, 2004 and No. 2005-042260 filed on Feb. 18, 2005, the contents of which is incorporated herein by reference.

FIELD OF THE INVENTION

The present invention relates to an ignition device for an internal combustion engine merging a spark plug for sparking in a spark gap and an ignition coil for supplying a large voltage current to the spark plug.

BACKGROUND OF THE INVENTION

Conventionally, an ignition device is known which merges a spark plug and an ignition coil in one housing as disclosed in U.S. Pat. No. 6,694,958-B and its counterpart JP-2003-297654-A for example. As shown in FIGS. 6 and 7, the ignition device has a male screw portion 22 formed on a housing 1 thereof to mount itself on an internal combustion engine. The male screw portion 22 is screw-fastened to a female screw portion 202 formed on a mounting hole 201 of a cylinder head 200 of the internal combustion engine.

The ignition device disclosed in U.S. Pat. No. 6,694,958-B, however, has an issue that a stress generated by mechanical vibrations of the internal combustion engine may snap the housing 1 a boundary between a fastened portion screw-fastened to the female screw portion 202 of the cylinder head 200 and a free portion. This issue is caused by a large distance between the screw-fastened portion and a barycenter of the ignition device and a large weight relative to a separate type spark plug.

Further, a clearance portion 13 is required at the boundary at an end of the male screw portion 11 of the housing 1 opposite to a combustion chamber of the internal combustion engine to form the male screw portion 11 on the housing 1. The clearance portion 13 has a diameter smaller than a diameter of the outer diameter of the male screw portion 11, and the ignition device may snap at the clearance portion 13 by the vibration of the internal combustion engine.

SUMMARY OF THE INVENTION

The present invention, in view of the above-described issue, has an object to provide an ignition device for an internal combustion engine merging a spark plug for sparking in a spark gap and an ignition coil for supplying a large voltage current to the spark plug The ignition device for an internal combustion engine has a spark plug, an ignition coil, a housing and a mounting portion. The spark plug is for discharging a current to ignite an air-fuel mixture in a combustion chamber of the internal combustion engine. The ignition coil is for supplying the current to the spark plug. The housing encloses the spark plug and the ignition coil therein. The housing has a mounting portion to be disposed in a mounting hole provided in a cylinder head of the internal combustion engine. The mounting portion includes a screw portion a non-screw portion. The screw portion is to be screw-fastened to the mounting hole. The non-screw portion is not to be screw-fastened to the mounting hole.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

First Embodiment

Figure 1:
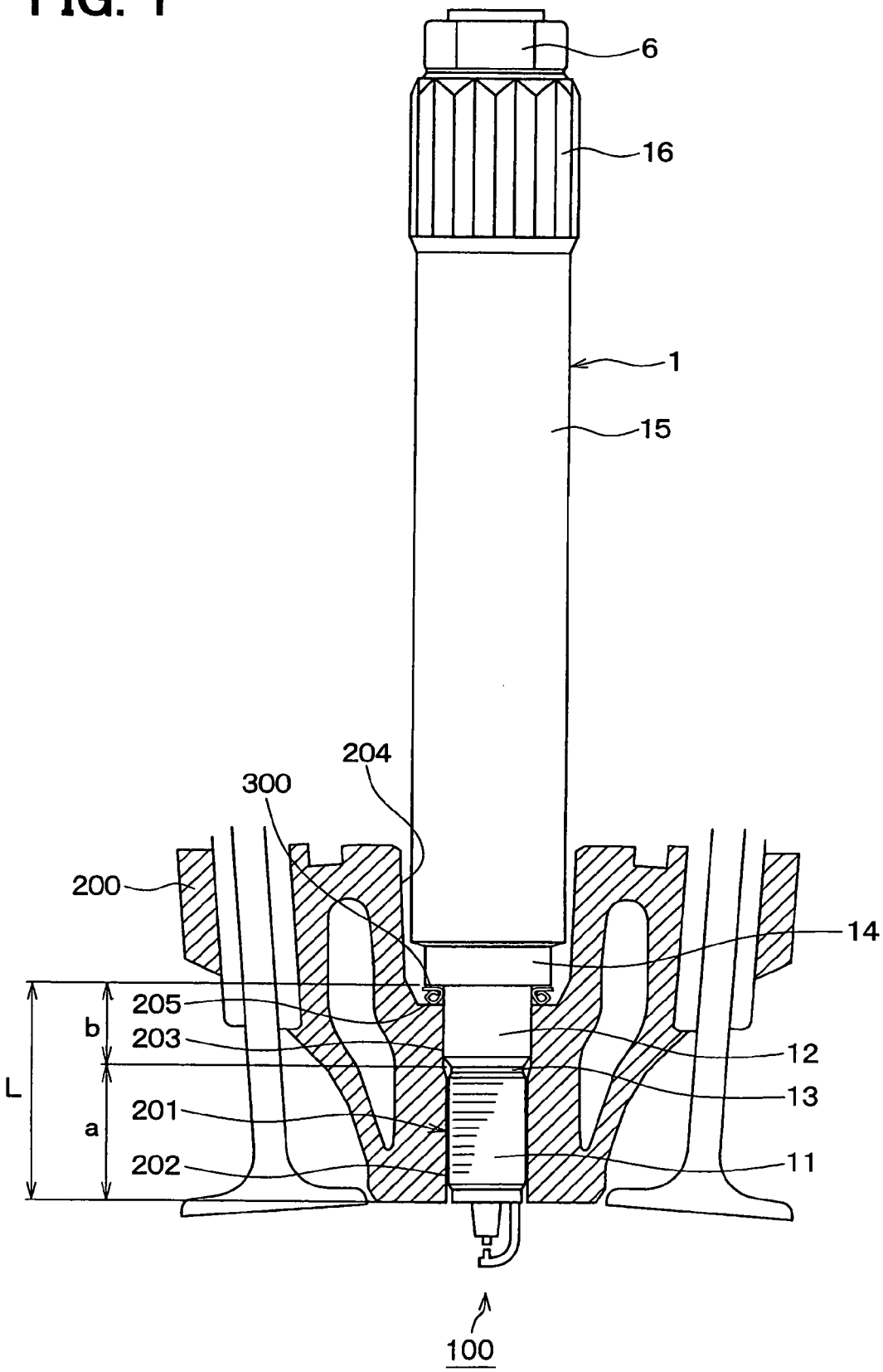
FIG. 1 is a side view showing a mounting state of an ignition device according to a first embodiment of the present invention on an internal combustion engine.
Figure 2:
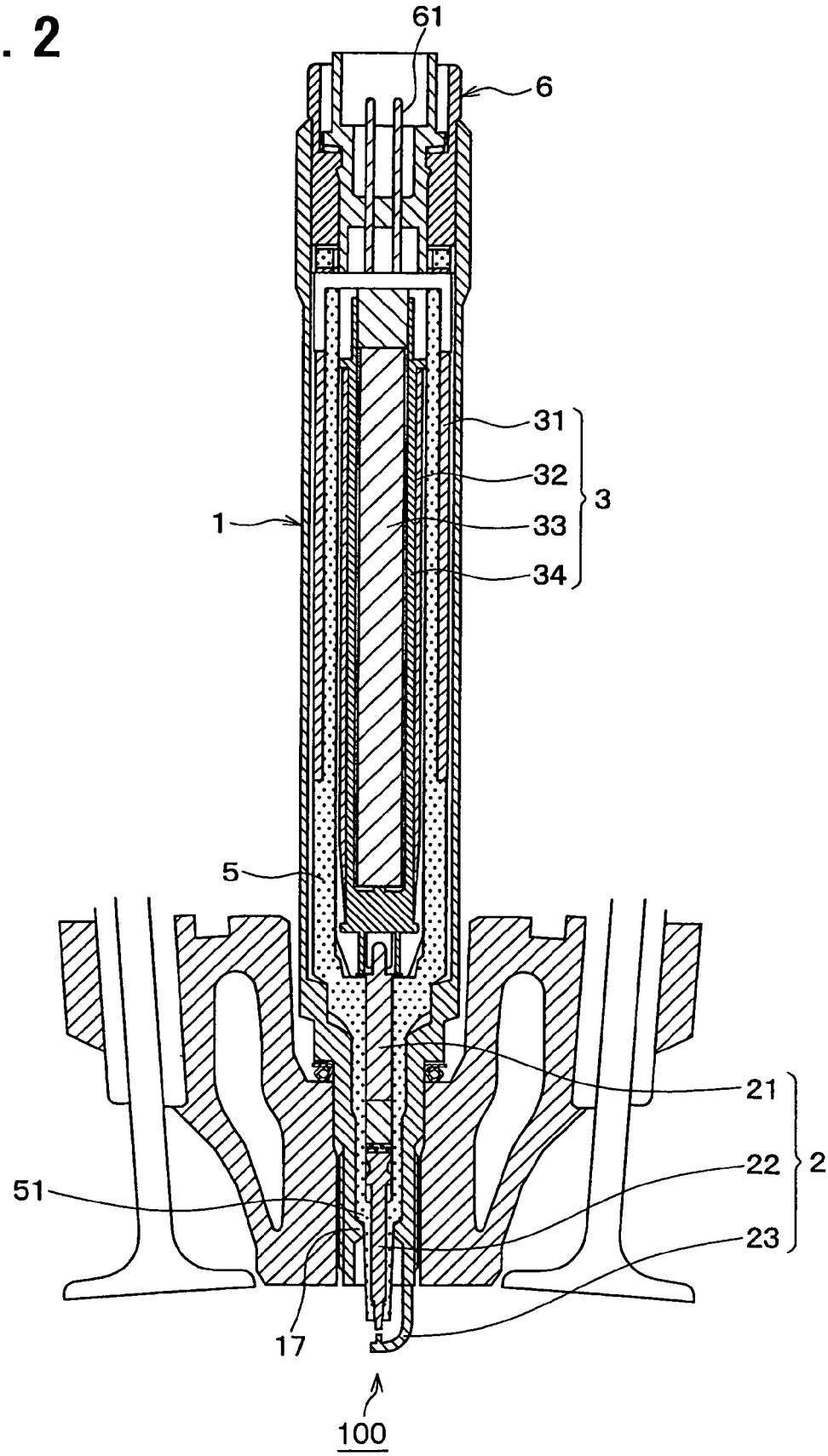
FIG. 2 is an enlarged cross-sectional view showing an inner structure of the ignition device according to the first embodiment.
Figure 3:
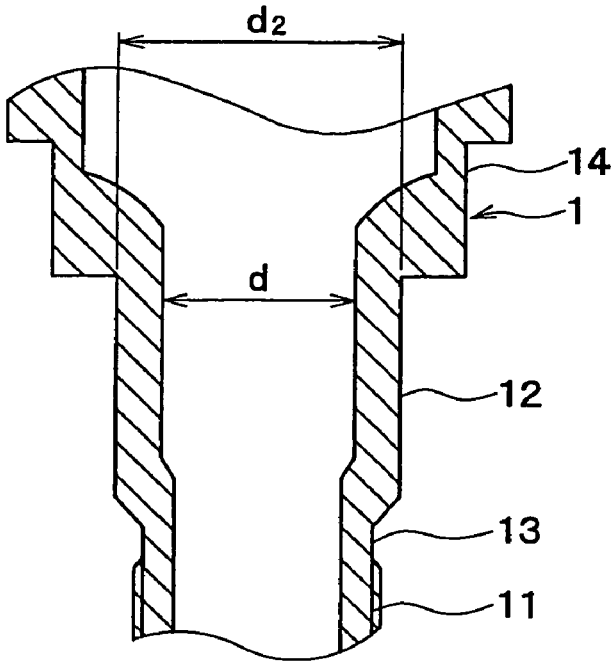
FIG. 3 is a cross-sectional view showing a boundary portion of the ignition device according to the first embodiment.

FIGS. 1 to 3 depict an ignition device according to a first embodiment of the present invention. The ignition device has a cylinder-shaped housing 1, a spark plug 2 and an ignition coil 3. The housing 1 encloses the spark plug 2 and the ignition coil 3 therein. The ignition device is mounted on a mounting hole 201 of a cylinder head 200 of an internal combustion engine to expose both terminals of the spark plug 2 in a combustion chamber of the internal combustion engine. The cylinder head 200 is made of aluminum.

The mounting hole 201 of the cylinder head 200 has a step as shown in FIGS. 1 and 2. The mounting hole 201 includes a female screw portion 202 formed at its end portion at a side of a combustion chamber 100 and a non-screw portion 203 formed between the step and the female screw portion 202. The non-screw portion 203 has a cylindrical shape and a bore diameter larger than a core diameter of the female screw portion 202. The cylinder head 200 further has a installing hole 204 disposed coaxial with the mounting hole 201 and between the mounting hole 201 and the outer face of the internal combustion engine. The installing hole 204 has a cylindrical shape and a bore diameter larger than the bore diameter of the non-screw portion 203 of the mounting hole 201.

The housing 1 is made of a conductive metallic material such as AISI 1045 (DIN C45) and AISI 430 (DIN X6Cr17 or DIN X10CrAl18) having a hardness larger than a hardness of the cylinder head 200. The outer circumferential face of the housing 1 has a male screw portion 11 disposed at its tip portion at a side of the combustion chamber 100. The outer circumferential face of the housing 1 further has a clearance portion 13 and a non-screw portion 12 that are contiguous to and coaxial with the male screw portion 11 in a longitudinal direction of the ignition device. The non-screw portion 12 has a cylindrical shape and an outer diameter larger than an outer diameter of the male screw portion 11. The clearance 13 has an outer diameter smaller than the outer diameter of the male screw portion 11.

The non-screw portions 12, 203 of the housing 1 and the cylinder head 200 each have constant outer diameter and bore diameter over their length in the longitudinal direction of the ignition device. The outer and bore diameters of the non-screw portions 12, 203 are determined so that the non-screw portion 12 of the housing 1 is press-fitted in the non-screw portion 203 of the cylinder head 200.

The outer circumferential face of the housing 1 has a step as shown in FIGS. 1 to 3. The outer circumferential face of the housing 1 further includes a middle diameter portion 14 that is contiguous to and coaxial with the non-screw portion 12 in a longitudinal direction of the ignition device. The outer circumferential face of the housing 1 still further includes a large diameter portion 15 that is contiguous to and coaxial with the middle diameter portion 14 in a longitudinal direction of the ignition device. The middle diameter portion 14 has a cylindrical shape and an outer diameter larger than an outer diameter of the non-screw portion 14. The large diameter portion 15 has a cylindrical shape and an outer diameter larger than an outer diameter of the middle diameter portion 14.

The outer circumferential face of the housing 1 has a nut portion 16 at its end portion opposite from the male screw portion 11. The nut portion 16 engages with a wrench to screw-fasten the male screw portion 11 of the ignition device to the female screw portion 202 of the cylinder head 200. The ignition device is mounted on the cylinder head 200 in such a manner of interposing a gasket ring 300 between an end face of the middle diameter portion 14 and a bottom face 205 of the installing hole 204. When the ignition device is screw-fastened to the cylinder head 200, the non-screw portion 12 of the housing 1 is press-fitted into the non-screw portion 203 of the cylinder head 200. As described above, the hardness of the housing 1 is larger than the hardness of the cylinder head 200 to deform the non-screw portion 203 of the cylinder head 200 elastically to bring the housing 1 in a secure contact with the cylinder head 200. The middle diameter portion 14 and the large diameter portion 15 are not in contact with the installing hole 204. In other words, the male screw portion 11 and the non-screw portion 12 of the housing 1 form a fastened portion. The middle diameter portion 14 and the large diameter portion 15 form a free portion.

The housing 1 encloses a cylinder-shaped insulator 5 made of electrical insulating ceramics therein. As shown in FIG. 2, an outer circumferential face of the insulator 5 has a contact face 51 in a proximity to the combustion chamber 100. An inner circumferential face of the housing 1 has a receiving face 17 formed in a stepped manner to be in contact with the contact face 51 of the insulator 5. The receiving face 17 and the contact face 51 interpose a metallic seal (not shown) to prevent a leakage of combustion gas through a gap therebetween.

The spark plug 2 includes a stem 21, a center electrode 22 and an earth electrode 23 that are made of conducting metal. The stem 21 and the center electrode 22 are inserted in a center hole provided in the insulator 5 so that one end portion of the center electrode 22 is exposed in the combustion chamber 100. The earth electrode 23 is integrated with the housing 1 by means of welding or the like, and faced to the one end portion of the center electrode 22.

The ignition coil 3 includes a primary winding 31, a secondary winding 32, a cylinder-shaped center core 33 made of magnetic material, a secondary spool 34 made of electrical insulating resin and formed in a blind-ended cylindrical shape, and others. The primary winding 31 is directly wound around the insulator 5. Both ends of the primary winding 31 are connected to connector terminals 61 of a connector 6 via through parts (not shown) to input control signals from an igniter (not shown) in the primary winding 31.

The secondary winding 32 is wound on an outer circumferential face of the secondary spool 34. The center core 33 is inserted in a central hole of the secondary spool 34. A resinous material with large electrical insulating ability such as epoxy resin fills a gap between the insulator 5 and the secondary spool 34. A high-voltage end of the secondary winding 32 is electrically connected via a stem 21 of the spark plug 2 to the central electrode 22. A low-voltage end of the secondary winding 32 is electrically connected via through parts (not shown) to the housing 1. The housing 1 is grounded via the cylinder head 200 to a vehicular body (not shown).

In the ignition device having the above-described configuration, the ignition coil 3 develops a large voltage in accordance with the control signals from the igniter. Then, the spark plug 2 discharges the large voltage in the spark gap to ignite an air-fuel mixture in the combustion chamber 100.

Figure 4:
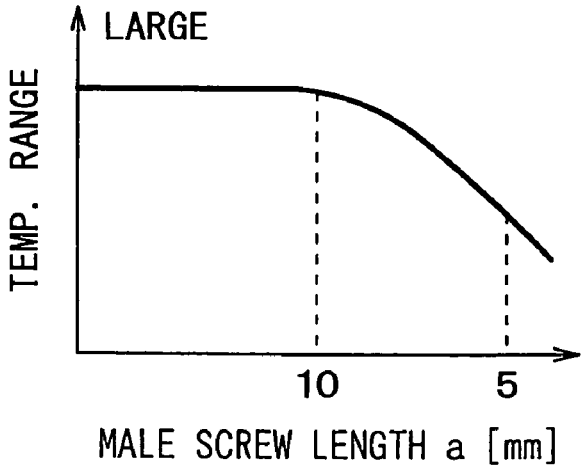
FIG. 4 is a graph showing a relation between a length of a screw portion and a heat range of the ignition device according to the first embodiment.

A required temperature range of the ignition device is secured by setting a length L of the fastened portion to 19 mm or 26.5 mm (long reach or extra-long reach in ISO 16246), even if the fastened portion include the non-screw portion. FIG. 4 schematically depicts a relation between the length "a" of the male screw portion 11 and the temperature range of the ignition device. The 10 mm of the length "a" is enough to secure the required temperature range of the ignition device. Thus, when the length L is 19 mm, a length b of the non-screw portion 12 can be 9 mm at the maximum. When the length L is 26.5 mm, a length b of the non-screw portion 12 can be 16.5 mm at the maximum. When the length L of the fastened portion is not in accordance with the ISO standard, the length b of the non-screw portion 12 will be $0<b\leqq(L-10)$.

Figure 7:
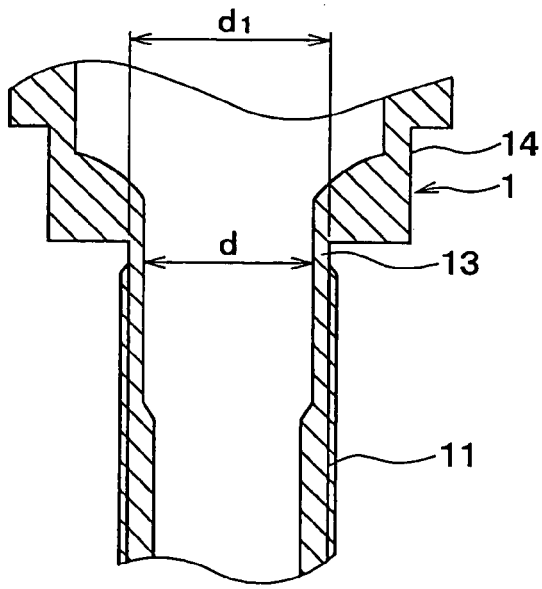
FIG. 7 PRIOR ART
FIG. 7 is a cross-sectional view showing a boundary portion of the conventional ignition device.
Figure 6:
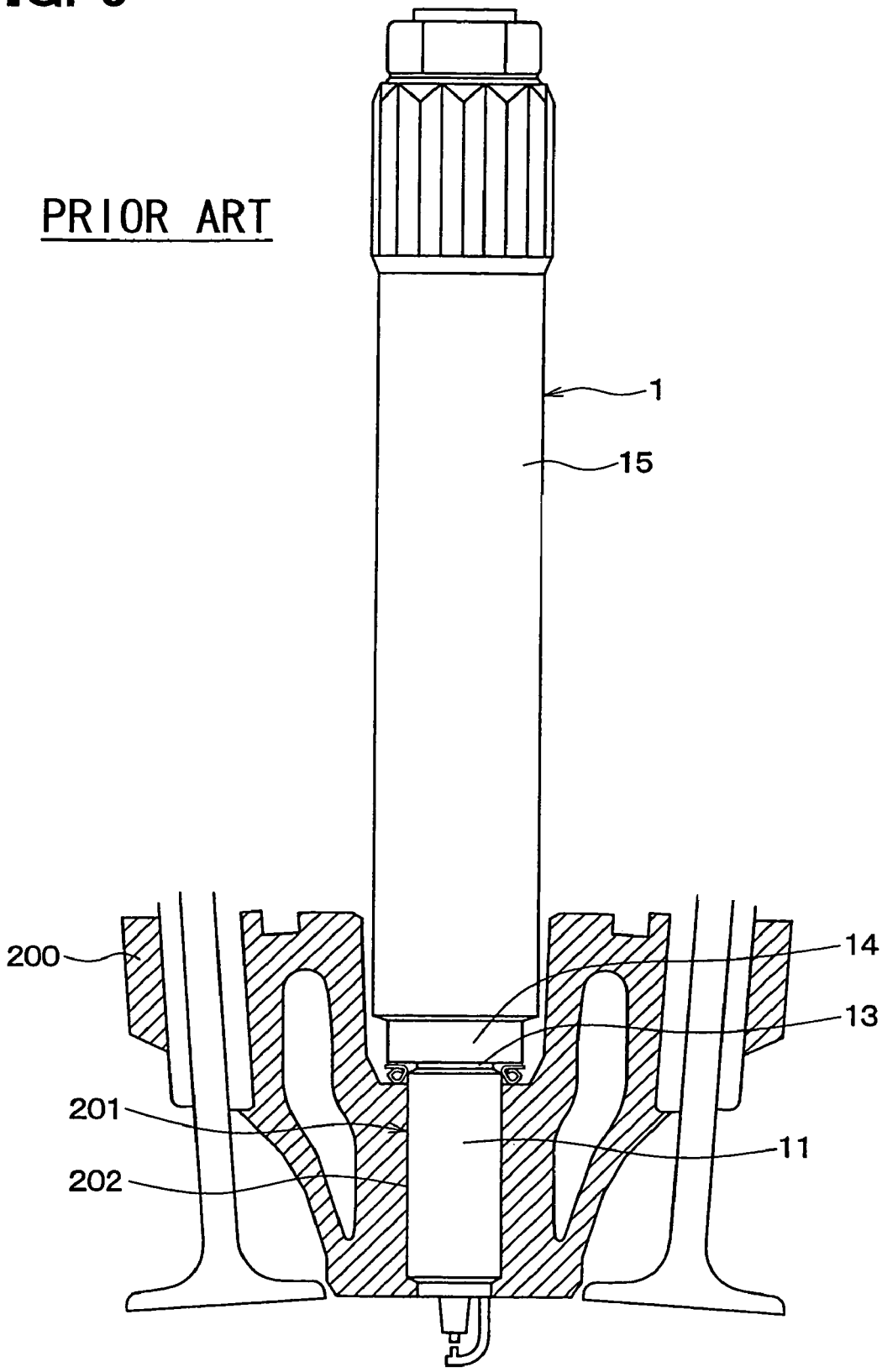
FIG. 6 is a side view showing a mounting state of a conventional ignition device.

As described above, when the fastened portion is provided with the non-screw portion 12, an end of the non-screw portion 12 at a side opposite from the combustion chamber 100 will be a boundary between the fastened portion and a free portion of the ignition device. A diameter of the ignition device at the boundary is larger than the diameters of the male screw portion 11 and the clearance portion 13. Thus, the material thickness at the boundary can be larger than that in a conventional ignition device that is shown in FIGS. 6 and 7. Accordingly, the strength at the boundary is increased to prevent the housing 1 from snapping by a vibration of the internal combustion engine.

For example, when a nominal diameter of the male screw portion 11 is M10, the inner diameter at the boundary will be 6.9 mm. The outer diameter d1 at the clearance portion in the conventional ignition device will be 9 mm (refer to FIG. 7) and the outer diameter d2 of the non-screw portion 12 of the ignition device according to the present embodiment can ordinarily be more than 10.6 mm (refer to FIG. 3). When the outer diameter d2 is set to 10.6 mm, the stress generation at the clearance portion will be decreased by 62%.

Second Embodiment

Figure 5:
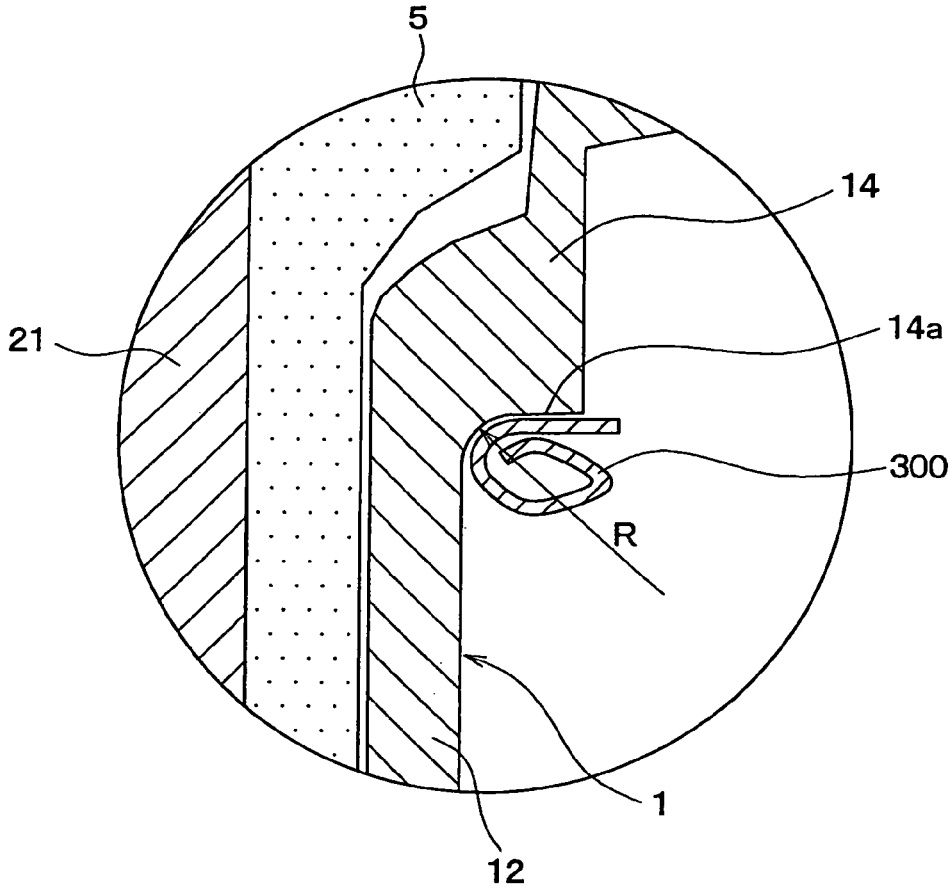
FIG. 5 is an enlarged cross-sectional view showing a principal portion of an ignition device for an internal combustion engine according to a second embodiment of the present invention.

FIG. 5 depicts a principal portion of an ignition device according to a second embodiment of the present invention. In the ignition device according to the second embodiment, the outer circumferential face of the non-screw portion 12 and the end face 14*a* of the middle diameter portion are connected by a curved side circumferential face to decrease a stress concentration at a boundary between the non-screw portion 12 and the middle diameter portion 14. Thus, the strength at the boundary between the non-screw portion 12 and the middle diameter portion 14 can be still further large to prevent the housing 1 from snapping more securely.

A radius of curvature R of the curved side circumferential face is set between 0 mm and 1 mm to prevent an interference between the curved side circumferential face and the gasket ring 300 and to increase the strength at the boundary.

Other Embodiments

Although in the above-described embodiments the non-screw portions 12, 203 of the hosing 1 and the cylinder head 200 have straight cylindrical shapes, it is also appropriate to form the non-screw portion 12 of the housing 1 in a tapered shape. Specifically, the non-screw portion 12 of the housing 1 may be tapered off from a middle diameter portion 14 side to a male screw portion 11 side. It is useful to set the maximum diameter of the tapered non-screw portion 12 larger than the inner diameter of the non-screw portion 203 and the minimum diameter of the tapered non-screw portion 12 smaller than the inner diameter of the non-screw portion 203. According to this configuration, the non-screw portion 12 of the housing 1 can be brought in still secure contact with the non-screw portion 203 of the cylinder head 200.

When the non-screw portion 12 of the housing 1 is tapered as described above, the non-screw portion 12 may be tapered over its entire length in the longitudinal direction of the ignition device. The non-screw portion 12 may also be tapered at a part in the longitudinal direction.

Additionally, although in the above-described embodiments the secondary winding 32 is disposed inside of the primary winding 31, the secondary winding 32 may be disposed outside of the primary winding 31.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. An ignition device for an internal combustion engine comprising:

a spark plug having a pair of electrodes for discharging a current therebetween to ignite an air-fuel mixture in a combustion chamber of the internal combustion engine;

an ignition coil for supplying the current to the spark plug; and a single-piece housing that encloses both the spark plug and the ignition coil therein such that the electrodes protrude outwardly from the housing, wherein the single-piece housing has a mounting portion configured to be fastened to a mounting hole provided in a cylinder head of the internal combustion engine to locate the electrodes inside the combustion chamber and to locate the ignition coil outside the combustion chamber, and the mounting portion includes:

a screw portion configured to be screw-fastened to the mounting hole; and a non-screw portion configured to be tightly fitted to the mounting hole.

2. The ignition device according to claim 1, wherein the housing further has a curved circumferential face that is curved in an imaginary plane parallel to a longitudinal direction of the spark plug and provides a smooth transition between circumferential faces of the mounting portion and a free portion of the housing, which is on an ignition coil side of the mounting portion.

3. The ignition device according to claim 2, wherein the curved circumferential face is arcuately curved and has a radius of curvature not larger than 1 mm.

4. The ignition device according to claim 1, wherein the length of the screw portion in the longitudinal direction of the spark plug is not smaller than 10 mm.

5. The ignition device according to claim 1, wherein the non-screw portion is pressure-fitted in the mounting hole.

6. The ignition device according to claim 1, wherein the non-screw portion is tapered off in the longitudinal direction of the spark plug.

7. The ignition device according to claim 1, wherein the housing has a hardness larger than a hardness of the cylinder head.

8. The ignition device according to claim 1, wherein:

the screw portion is located closer to the electrodes than the non-screw portion is; and a diameter of the non-screw portion at a position furthest from the screw portion is larger than a diameter of the screw portion.

9. The ignition device according to claim 1, wherein the ignition coil includes a primary winding and a secondary winding, which are received in the single-piece housing.

10. An ignition device for an internal combustion engine, the ignition device comprising:

a spark plug that has a pair of electrodes to discharge a current therebetween and thereby to ignite an air-fuel mixture in a combustion chamber of the internal combustion engine;

an ignition coil that is operable to supply the current to the spark plug; and a metal housing that encloses both the spark plug and the ignition coil inside the housing, wherein the housing has a mounting portion configured to be received inside a mounting hole provided in a cylinder head of the internal combustion engine, and the mounting portion includes:

a screw portion that has external threads configured for threaded engagement with internal threads inside the mounting hole; and a non-threaded, non-screw portion that is located on an ignition coil side of the screw portion and is configured to be received inside the mounting hole, wherein the non-screw portion has a smooth cylindrical outer peripheral surface, which makes a surface-to-surface contact with a smooth cylindrical inner peripheral surface portion of the mounting hole.

11. The ignition device according to claim 10, wherein the housing further has a curved circumferential face that is curved in an imaginary plane parallel to a longitudinal direction of the spark plug and provides a smooth transition between circumferential faces of the mounting portion and of a free portion of the housing, which is on an ignition coil side of the mounting portion.

12. The ignition device according to claim 11, wherein the curved circumferential face is arcuately curved and has a radius of curvature not larger than 1 mm.

13. The ignition device according to claim 10, wherein the length of the screw portion in a longitudinal direction of the spark plug is not smaller than 10 mm.

14. The ignition device according to claim 10, wherein the non-screw portion is pressure-fitted in the mounting hole.

15. The ignition device according to claim 10, wherein the non-screw portion is tapered off in a longitudinal direction of the spark plug.

16. The ignition device according to claim 10, wherein the housing has a hardness larger than a hardness of the cylinder head.

17. The ignition device according to claim 10, wherein:

the screw portion is located closer to the electrodes than the non-screw portion is; and a diameter of the non-screw portion at a position furthest from the screw portion is larger than a diameter of the screw portion.

18. The ignition device according to claim 10, wherein the ignition coil includes a primary winding and a secondary winding, which are received in the single-piece housing.

* * * * *